US012285093B2

(12) United States Patent
Beugels et al.

(10) Patent No.: US 12,285,093 B2
(45) Date of Patent: Apr. 29, 2025

(54) IMPROVING HAIR-CLAMPING PERFORMANCE OF A PAIR OF HAIR-CLAMPING ELEMENTS

(71) Applicant: KONINKLIJKE PHILIPS N.V., Eindhoven (NL)

(72) Inventors: Johannes Beugels, Peize (NL); Joost Tomas Glazenburg, Groningen (NL); Geert Willem De Goeij, Drachten (NL); Robbert Freerk Johan Van Der Scheer, Groningen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 221 days.

(21) Appl. No.: 17/922,457

(22) PCT Filed: May 19, 2021

(86) PCT No.: PCT/EP2021/063216
§ 371 (c)(1),
(2) Date: Oct. 31, 2022

(87) PCT Pub. No.: WO2021/239524
PCT Pub. Date: Dec. 2, 2021

(65) Prior Publication Data

US 2023/0165354 A1 Jun. 1, 2023

(30) Foreign Application Priority Data

May 26, 2020 (EP) ..... 20176618

(51) Int. Cl.
*A45D 26/00* (2006.01)

(52) U.S. Cl.
CPC ..... *A45D 26/0076* (2013.01); *A45D 26/0028* (2013.01)

(58) Field of Classification Search
CPC ..... A45D 26/0023; A45D 26/0028; A45D 26/0066; A45D 26/0071; A45D 26/0076
See application file for complete search history.

(56) References Cited

U.S. PATENT DOCUMENTS

| | | | |
|---|---|---|---|
| 11,369,179 B2 | 6/2022 | Lau | |
| 2007/0093853 A1 | 4/2007 | Poran | |
| 2008/0045975 A1* | 2/2008 | Sanchez-Martinez | A45D 26/0028 30/45 |

FOREIGN PATENT DOCUMENTS

| | | |
|---|---|---|
| CN | 101513303 A | 8/2009 |
| EP | 2127552 A1 | 12/2009 |

(Continued)

OTHER PUBLICATIONS

International search report for patent application No. PCT/EP2021/063216 dated Aug. 4, 2021.

*Primary Examiner* — Todd J Scherbel

(57) ABSTRACT

A head unit of a depilation appliance comprises at least one pair (11) of hair-clamping elements (12, 13), wherein the hair-clamping elements (12, 13) have tweezer surfaces (14, 15) which are arranged to face each other, and which are movable towards and away from each other in their entirety so as to be movable into and out of contact to each other. In order to achieve improved hair-clamping performance of the at least one pair (11) of hair-clamping elements (12, 13), the tweezer surfaces (14, 15) are further configured to move into alignment with each other in the process of getting into contact to each other, wherein the entirety of the tweezer surface (14) of one (12) of the hair-clamping elements (12, 13) is tillable relative to a support (17) that is included in the respective hair-clamping element (12).

20 Claims, 5 Drawing Sheets

(56) References Cited

FOREIGN PATENT DOCUMENTS

| | | | |
|---|---|---|---|
| EP | 2719298 | A2 | 4/2014 |
| EP | 2719298 | A3 | 9/2017 |
| WO | 9930591 | A1 | 6/1999 |
| WO | 0193767 | A1 | 12/2001 |
| WO | 2004017786 | A1 | 3/2004 |
| WO | 2006037393 | A1 | 4/2006 |
| WO | 2020060373 | A1 | 3/2020 |
| WO | 2020070218 | A1 | 4/2020 |

* cited by examiner

IMPROVING HAIR-CLAMPING PERFORMANCE OF A PAIR OF HAIR-CLAMPING ELEMENTS

CROSS-REFERENCE TO PRIOR APPLICATIONS

This application is the U.S. National Phase application under 35 U.S.C. § 371 of International Application No. PCT/EP2021/063216, filed on May 19, 2021, which claims the benefit of European Patent Application No. 20176618.5, filed on May 26, 2020. These applications are hereby incorporated by reference herein.

FIELD OF THE INVENTION

The invention relates to a head unit of a depilation appliance, comprising at least one pair of hair-clamping elements, wherein the hair-clamping elements have tweezer surfaces which are arranged to face each other, and which are movable towards and away from each other in their entirety so as to be movable into and out of contact to each other.

The invention also relates to a depilation appliance, comprising a head unit as mentioned and a body unit configured to allow a user to take hold of the depilation appliance.

BACKGROUND OF THE INVENTION

In the field of depilation appliances, several working principles can be applied for the purpose of removing hair from skin. All of these working principles rely on a sequence of an action of clamping the hair and an action of pulling the hair out of the skin.

In general, an electric depilation appliance comprises a head unit configured to be moved along the skin and a body unit configured to allow a user to take hold of the depilation appliance. The head unit comprises a functional body that is driven during operation to actually allow the two actions as mentioned, i.e. the action of clamping the hair and the action of pulling the hair out of the skin, to take place. In one known type of depilation appliance, the functional unit includes a number of pairs of hair-clamping elements, wherein the hair-clamping elements of each pair have tweezer surfaces which are arranged to face each other, and which are movable towards and away from each other in their entirety so as to be movable into and out of contact to each other. Also, the hair-clamping elements are rotatably arranged in the head unit. When during operation the functional body is at a position close to the skin, hair protruding from the skin is allowed to enter a narrow space between the tweezer surfaces during the time that the tweezer surfaces are spaced apart, and is clamped between the tweezer surfaces when the tweezer surfaces have moved into contact to each other. Due to the rotation movement of the hair-clamping elements, the hair that is clamped between the tweezer surfaces is pulled out of the skin. The movement of the tweezer surfaces towards and away from each other and the rotation movement of the hair-clamping elements continually take place during operation, so that a process of removing hair from skin can be performed on successive batches of hair until there is no hair left on the skin.

In a commonly known design of the head unit of a depilation appliance, the hair-clamping elements comprise discs, wherein the discs are arranged so as to be reciprocated in a longitudinal direction, i.e. a direction in which a longitudinal axis of the discs extends, and to be rotatable about a rotation axis extending in the longitudinal direction, and wherein the tweezer surfaces are present on the discs at the position of main body surfaces of the discs. In an alternative design, the functional body comprises a roller and the hair-clamping elements comprise plates which are arranged to reciprocate in the roller during operation. In both cases, the tweezer surfaces have a flat appearance, and the extent to which the tweezer surfaces are capable to actually clamp hair between them is influenced by the extent to which the tweezer surfaces are actually parallel to each other. The fact is that due to factors such as manufacturing tolerances or warpage, the intended parallel orientation of the tweezer surfaces of a pair of hair-clamping elements is often compromised in practice so that the hair-clamping performance of the pair of hair-clamping elements is less than envisaged. The reason is that when the tweezer surfaces are not properly aligned, contact pressure between the tweezer surfaces is lower than intended and the size of an effective clamping area between the tweezer surfaces is smaller than intended, so that it may happen that the tweezer surfaces are not capable to clamp a number of individual hairs in an area of skin covered by the functional body tight enough to actually pull those hairs from the skin, which necessitates having the functional body at the position of covering the area of skin during a longer period of time before all of the hair is removed from the area of skin. In general, non-optimal depilation performance is annoying to a user and may cause the user to doubt quality of the depilation appliance including the head unit.

SUMMARY OF THE INVENTION

It is an object of the invention to alleviate the problems addressed in the foregoing, i.e. the problems associated with the known designs of the head unit of a depilation appliance, and to thereby achieve improved hair-clamping performance of a pair of hair-clamping elements.

In view of the foregoing, the invention provides a head unit of a depilation appliance, comprising at least one pair of hair-clamping elements, wherein the hair-clamping elements have tweezer surfaces which are arranged to face each other, which are movable towards and away from each other in their entirety so as to be movable into and out of contact to each other, and which are configured to move into alignment with each other in the process of getting into contact to each other, wherein the entirety of the tweezer surface of one of the hair-clamping elements is tiltable relative to a support that is included in the respective hair-clamping element.

According to an insight underlying the invention, the fact that the tweezer surfaces are moved into contact to each other at the time that hair that is positioned between the tweezer surfaces needs to be clamped tightly enough for allowing the action of pulling the hair from the skin to be performed effectively can be used to advantage. When the invention is put to practice, the relative movement of the tweezer surfaces towards each other is used for causing the tweezer surfaces to move into alignment relative to each other. This is done on the basis of a design of the head unit in which the entirety of the tweezer surface of one of the hair-clamping elements is tiltable relative to a support that is included in the respective hair-clamping element. In the head unit according to this design, the tiltability of the tweezer surface in the respective hair-clamping element enables adjustment of the orientation of the tweezer surface in the process of getting into contact to the other tweezer surface, wherein the tweezer surface is pushed into alignment with the other tweezer surface, as it were. An interesting aspect of having a tiltable arrangement of the tweezer surface in a hair-clamping element resides in the possibility of realizing the tiltability by means of an add-on, as will be explained later. It may be practical if the other tweezer surface has a fixed position in the respective hair-clamping element.

As explained in the foregoing in respect of conventional head units, it is practical if the tweezer surfaces have a flat appearance, in which case the tweezer surfaces are made to extend parallel to each other when they align relative to each other. In this way, the largest possible effective clamping area can be realized, while the clamping action on the hair can be performed with the highest possible force, in conformity with what is theoretically intended. In any case, according to the invention, the entirety of the tweezer surface of one of the hair-clamping elements is tiltable relative to a support that is included in the respective hair-clamping element. In this respect, it is practical if the respective hair-clamping element is equipped with a tilting element that is tiltably arranged on the support, wherein the tweezer surface is included in the tilting element.

In the following, for the sake of clarity, the hair-clamping element in which the tweezer surface is tiltable relative to a support that is included in the respective hair-clamping element will be referred to as adjustable hair-clamping element. The tilting element may be provided as an add-on on a main body of the adjustable hair-clamping element, in which case the capability of the tweezer surface of the adjustable hair-clamping element to align with the tweezer surface of the other hair-clamping element when contact to the tweezer surface of the other hair-clamping element is established is obtained without a need for complex measures. The adjustable hair-clamping element may be further equipped with a biasing mechanism acting on the tilting element to bias the tilting element to a default position relative to the support. This allows for having the tweezer surface that is included in the tilting element at an orientation in which the tweezer surface is more or less parallel to the tweezer surface of the other hair-clamping element when the tweezer surfaces are on their way towards each other or are moving apart, or at any other advantageous orientation such as an orientation that is adapted to the orientation of another surface of the adjustable hair-clamping element. A biasing mechanism as mentioned my comprise a leaf spring, for example, or may be designed in any other appropriate way.

In the case that the adjustable hair-clamping element includes a biasing mechanism as mentioned, it is possible to have a configuration in which the tilting element is in a spring-loaded arrangement on the support through the biasing mechanism. Such a configuration may very well allow for alignment of the tweezer surface included in the tilting element with the tweezer surface of the other hair-clamping element, wherein the first tweezer surface can be pushed to the aligned position relative to the latter tweezer surface when the tweezer surfaces are advanced towards each other, against the action of the biasing mechanism. As soon as the tweezer surfaces move out of contact to each other, the tilting element is put back to the default position in the adjustable hair-clamping element by the biasing mechanism.

In another feasible embodiment of the head unit, which can be with or without a biasing mechanism as mentioned, the support comprises a rib, and the tilting element is arranged on the support at the position of the rib and is tiltable relative to the support about a tilting axis extending in the longitudinal direction of the rib.

The tilting element of the adjustable hair-clamping element may be of any suitable design. An example of such a design is a design according to which the tilting element comprises a bracket clamped around the support.

It may be practical if the head unit includes more than one pair of hair clamping elements. For the purpose of realizing the movement of the tweezer surfaces of the at least one pair of hair-clamping elements towards and away from each other, the head unit may be equipped with any suitable mechanism, which mechanism may be configured to actively push and pull the hair-clamping elements, for example. Further, for the purpose of enabling a hair pulling action, it is advantageous if the hair-clamping elements are rotatably arranged in the head unit.

The invention also relates to a depilation appliance comprising a head unit as described in the preceding paragraphs and a body unit configured to allow a user to take hold of the depilation appliance. It is also practical if the body unit serves for accommodating a source such as a rechargeable battery for providing the energy that is necessary for realizing the movement of the tweezer surfaces towards and away from each other and the possible rotation movement of the hair-clamping elements. It is further practical if the head unit and the body unit are releasably connectable to each other, so that a user of the depilation appliance is allowed to exchange head units, or so that cleaning of the head unit may be facilitated.

The above-described and other aspects of the invention will be apparent from and elucidated with reference to the following detailed description of various measures aimed at providing the tweezer surfaces of the hair-clamping elements of a head unit of a depilation appliance with a functionality of automatically aligning relative to each other during operation.

BRIEF DESCRIPTION OF THE DRAWINGS

The invention will now be explained in greater detail with reference to the figures, in which equal or similar parts are indicated by the same reference signs, and in which.

DETAILED DESCRIPTION OF THE EMBODIMENTS

Figure 1:
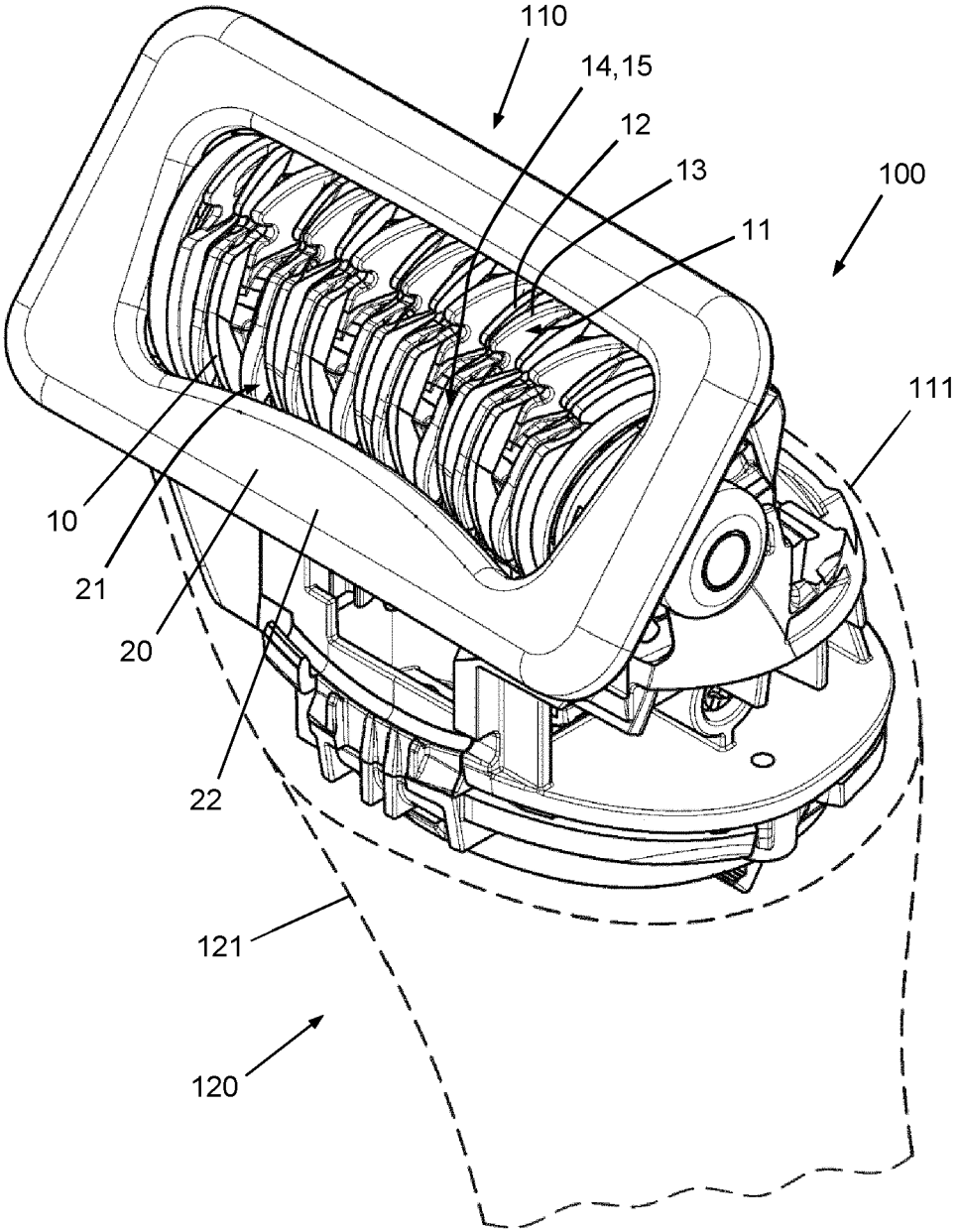
FIG. 1 diagrammatically shows a perspective view of a head unit and a portion of a body unit of a conventional depilation appliance, FIG. 2 diagrammatically shows a perspective view of a portion of a hair-clamping element of a head unit according to a first embodiment of the invention, the hair-clamping element including a support and a tilting element arranged on the support, FIG. 3 diagrammatically shows an enlarged perspective view of the support and the tilting element.

FIG. 1 diagrammatically shows a perspective view of a head unit 110 and a portion of a body unit 120 of a depilation appliance 100 known from international patent application WO 2020/070218 A1 in the name of the present applicant, wherein a housing 111 of the head unit 110 and a housing 121 of the body unit 120 are represented in dashed lining. With reference to FIG. 1, general aspects of the constitution of the known depilation appliance 100 and particularly the head unit 110 thereof are explained, which are equally applicable to the depilation appliance according to the invention.

The head unit 110 and the body unit 120 may be releasably connectable to each other. Preferably, as is the case in the shown example, the head unit 110 is pivotable relative to the body unit 120 in the assembled condition of the depilation appliance 100. The head unit 110 comprises a functional body 10 which is designed to perform the actions of clamping hair and pulling hair from skin during operation. To this end, the functional body 10 comprises a number of pairs 11 of hair-clamping elements 12, 13, wherein the hair-clamping elements 12, 13 are configured as discs which are rotatably arranged on a curved supporting shaft (not visible in FIG. 1). The hair-clamping elements 12, 13 have tweezer surfaces 14, 15 which are arranged to face each other, and which are movable towards and away from each other in their entirety so as to be movable into and out of contact to each other. During operation, the action of clamping hair takes place at the position of the tweezer surfaces 14, 15. The relative movement of the tweezer surfaces 14, 15 can be realized by invoking a movement of the hair-clamping elements 12, 13 towards and away from each other, wherein it is to be noted that the invention covers the different options of moving both hair-clamping elements 12, 13 of a pair 11 in the process or only moving one of the hair-clamping elements 12, 13 of a pair 11.

Mechanisms for causing continuous movement of the hair-clamping elements 12, 13 towards and away from each other and for rotating the hair-clamping elements 12, 13 at the same time are known per se and will not be further deliberated on here as the invention does not pertain to those aspects of the depilation appliance 100. In general, it is noted that the depilation appliance 100 is an electric appliance that can be equipped with an electric motor for driving various components of the electric appliance 100, and that can have an electric cord for connection to the mains and/or a suitable battery or the like.

In the shown example, the head unit 110 comprises a skin-contacting member 20 having a hair access opening 21 and a skin-contacting surface 22. It is to be noted that the head unit according to the invention does not necessarily need to include such a skin-contacting member 20.

Figure 2:
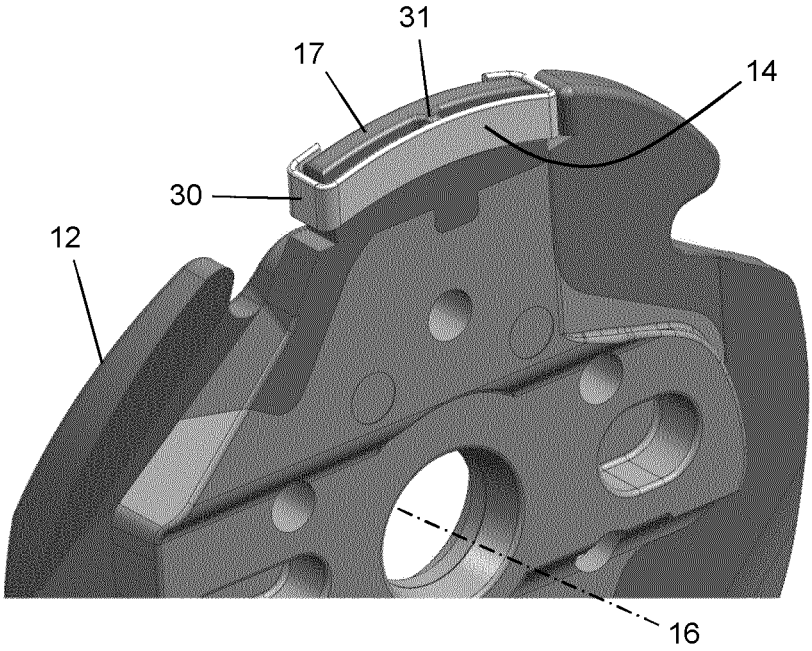
Figure 3:
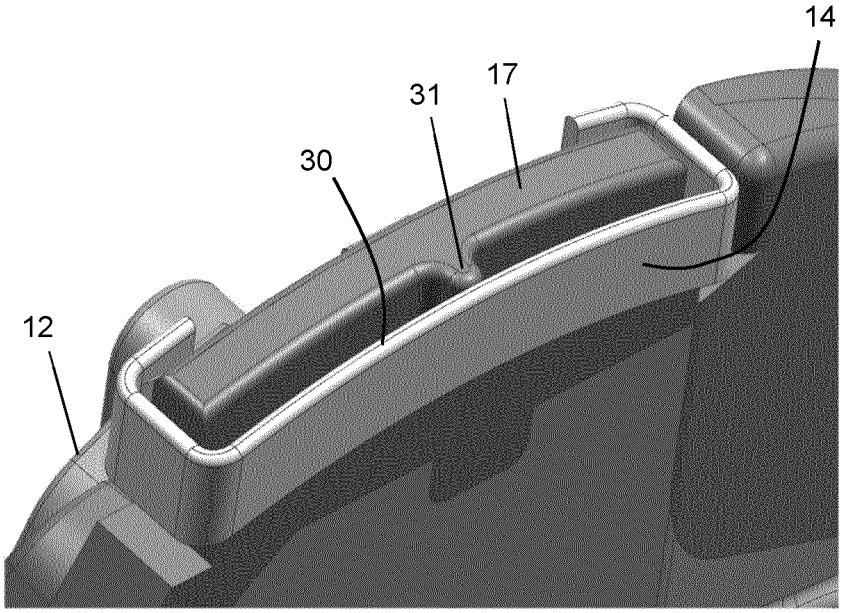

FIGS. 2 and 3 show different portions of a hair-clamping element 12 of a head unit according to a first embodiment of the invention. In order to distinguish this hair-clamping element 12 from the other hair-clamping element 13 of the respective pair 11 in the present text, this hair-clamping element 12 will be referred to as adjustable hair-clamping element 12. A longitudinal axis 16 of the adjustable hair-clamping element 12 is depicted in FIG. 2 as a dash-and-dot line. During operation, the adjustable hair-clamping element 12 is rotated about a rotation axis extending in the longitudinal direction, and the longitudinal direction is also the direction in which the hair-clamping elements 12, 13 of a pair 11 are continuously moved towards and away from each other.

The adjustable hair-clamping element 12 includes a support 17 and a tilting element 30 arranged on the support 17. Further, it is to be noted that the tweezer surface 14 of the adjustable hair-clamping element 12 is included in the tilting element 30 and has a flat appearance. An example of a suitable material of the tilting element 30 is metal, wherein the rest of the adjustable hair-clamping element 12 may be made of plastic, and wherein the other hair-clamping element 13 included in the respective pair 11 may be entirely made of plastic, which does not alter the fact that other materials may be chosen as well in the framework of the invention.

Figure 4:
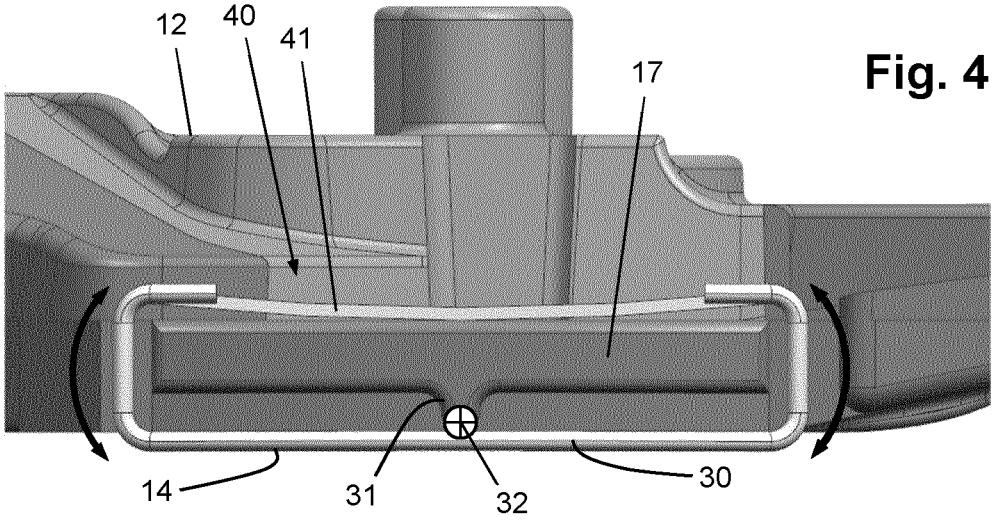
FIG. 4 illustrates how the tilting element is movable relative to the support.

The tilting element 30 comprises a bracket clamped around the support 17, wherein a cross-sectional shape of the tilting element 30 is a U shape with inwardly bent ends of the legs of the U shape in the shown example. The support 17 comprises a rib 31, wherein the tilting element 30 is arranged on the support 17 at the position of the rib 31 and is tiltable relative to the support 17 about a tilting axis 32 extending in the longitudinal direction of the rib 31, as indicated in FIG. 4, wherein a tilting movement of the tilting element 30 about the tilting axis 32 is indicated by means of two curved arrows at either side of the tilting element 30 in FIG. 4.

The adjustable hair-clamping element 12 further includes a biasing mechanism 40 acting on the tilting element 30 to bias the tilting element 30 to a default position relative to the support 17. In the shown example, the biasing mechanism 40 comprises a leaf spring 41 that is arranged at a side of the support 17 that can be denoted as back side when the side of the support 17 where the rib 31 is present is denoted as front side, wherein ends of the leaf spring 41 engage with the inwardly bent ends of the legs of the U shape of the tilting element 30, and wherein a slightly curved middle section of the leaf spring 41 contacts the support 17, as can be seen in FIG. 4.

Figure 5:
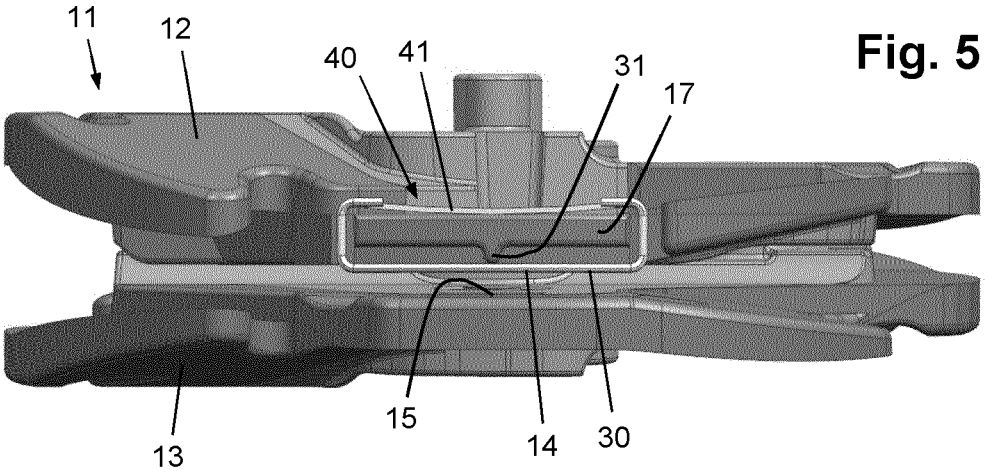
FIG. 5 illustrates a first option in respect of a default position of the tilting element relative to the support.
Figure 6:
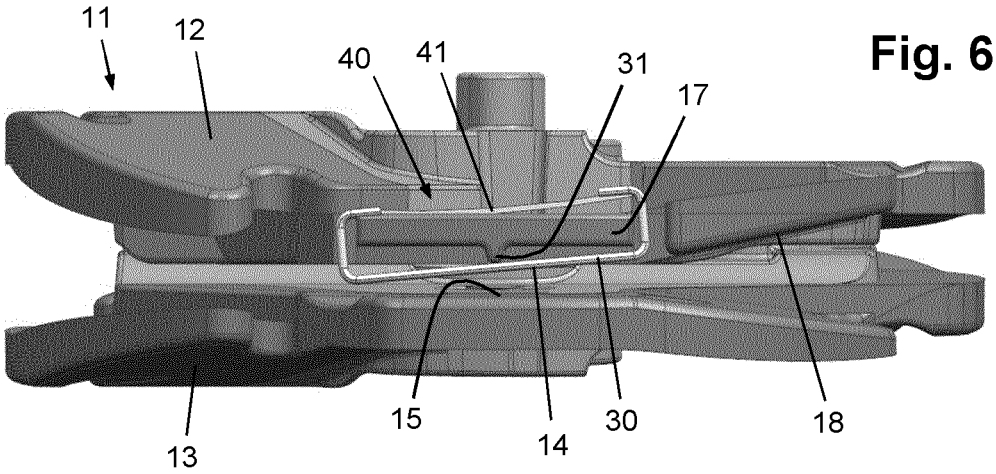
FIG. 6 illustrates a second option in respect of a default position of the tilting element relative to the support.

In FIGS. 5 and 6, two options in respect of the default position of the tilting element 30 relative to the support 17 are illustrated. According to the option illustrated in FIG. 5, the default position of the tilting element 30 relative to the support 17 is a position in which the tilting element 30 is oriented such that the tweezer surface 14 extends substantially perpendicular to the longitudinal direction, so that the tweezer surface 14 is more or less parallel to the tweezer surface 15 of the other hair-clamping element 13 included in the respective pair 11. According to the option illustrated in FIG. 6, the default position of the tilting element 30 relative to the support 17 is a position in which the tilting element 30 is oriented such that the tweezer surface 14 is tilted and non-parallel to the tweezer surface 15 of the other hair-clamping element 13 included in the respective pair 11. In fact, according to the option illustrated in FIG. 6, the default position of the tilting element 30 relative to the support 17 can be a position in which the tilting element 30 is oriented such that the tweezer surface 14 is aligned with a beveled funnel surface 18 of the adjustable hair-clamping element 12, as shown.

Figure 7:
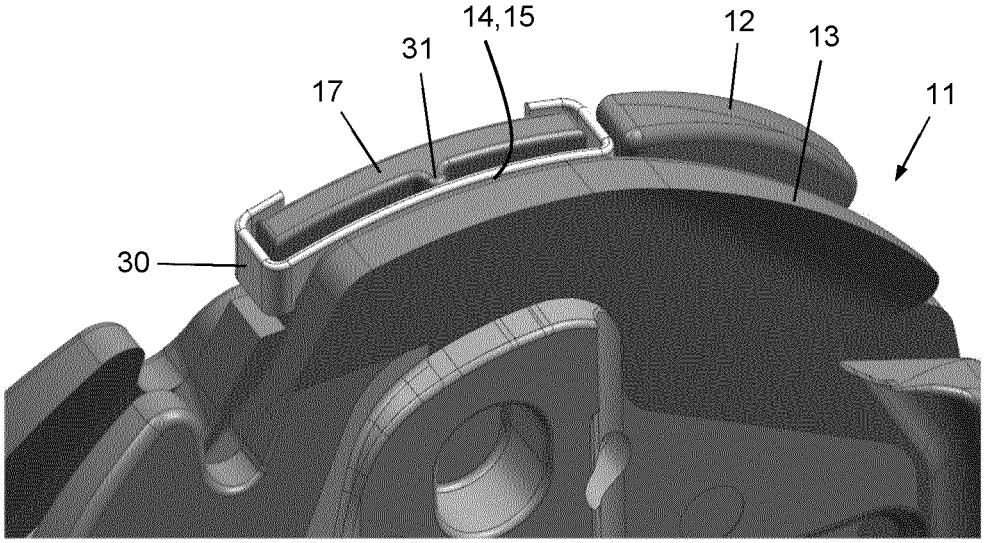
FIGS. 7 and 8 illustrate how a tweezer surface of the tilting element contacts a tweezer surface of an adjacent hair-clamping element, and FIG. 9 diagrammatically shows a perspective view of a portion of a hair-clamping element of a head unit according to a second embodiment of the invention, the hair-clamping element including a support and a tilting element arranged on the support.
Figure 8:
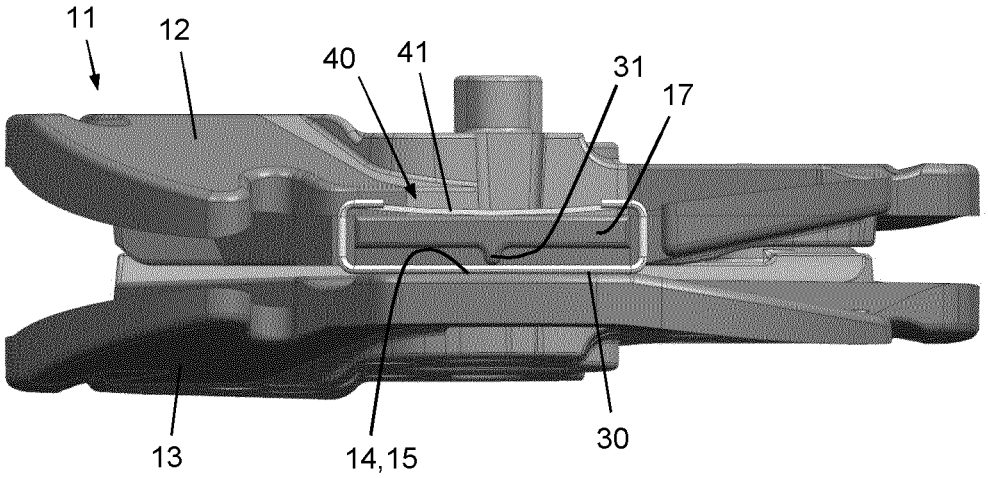

On the basis of the presence of the tilting element 30 in the adjustable hair-clamping element 12, it is achieved that when the adjustable hair-clamping element 12 and the other hair-clamping element 13 included in the respective pair 11 are moved towards each other and contact is established between the tweezer surfaces 14, 15 of the hair-clamping elements 12, 13 in the process, the tweezer surface 14 of the adjustable hair-clamping element 12 aligns with the tweezer surface 15 of the other hair-clamping element 13. The situation in which the tweezer surface 14 of the adjustable hair-clamping element 12 has actually been pushed into alignment with the tweezer surface 15 of the other hair-clamping element 13 is illustrated in FIGS. 7 and 8. Aligning the tweezer surfaces 14, 15 relative to each other is advantageous because the more accurate the alignment is, the better the hair-clamping performance of the pair 11 of hair-clamping elements 12, 13 is. In this respect, it is noted that if it was not for the measures of the invention, tweezer surface misalignment may occur in practice due to factors such as manufacturing tolerances or warpage.

When the tweezer surfaces 14, 15 are made to move apart, the tweezer surface 14 of the adjustable hair-clamping element 12 is allowed to be put in the default position under the influence of the action of the biasing mechanism 40. For the sake of completeness, it is noted that it is advantageous if the adjustable hair-clamping element 12 is equipped with the biasing mechanism 40, but that this is not essential. When the biasing mechanism 40 is present in the adjustable hair-clamping element 12, indeed, it is achieved that the tweezer surface 14 of the adjustable hair-clamping element 12 is alternately put to the aligned position under the influence of contact to the tweezer surface 15 of the other hair-clamping element 13 of the respective pair 11 and to the default position under the influence of the action of the biasing mechanism 40 during operation.

Figure 9:
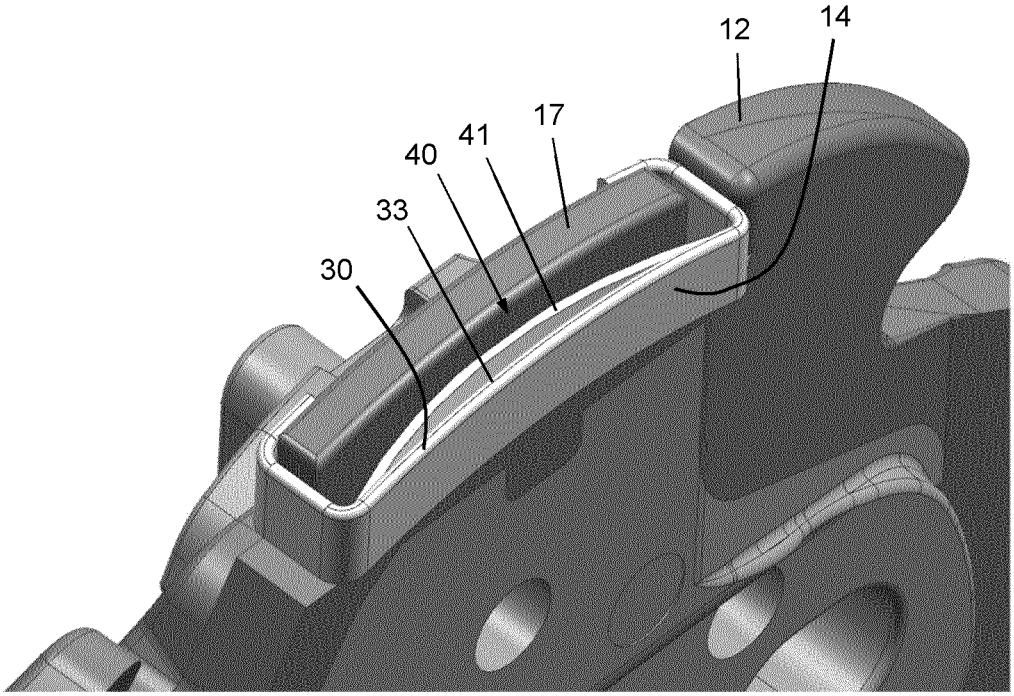

It follows from the foregoing that the head unit according to the invention is designed such that the tweezer surfaces 14, 15 of hair-clamping elements 12, 13 of a pair 11 of hair-clamping elements 12, 13 are made to gradually align relative to each other as the tweezer surfaces 14, 15 are moved towards each other for the purpose of clamping hair between them. FIG. 9 illustrates an alternative option of a design of the head unit that is aimed at realizing the functionality as mentioned.

FIG. 9 relates to a head unit according to a second embodiment of the invention. In the figure, the application of a tilting element 30 that is similar to the tilting element 30 of the head unit according to the first embodiment of the invention is illustrated. The tilting element 30 is also arranged so as to be tiltable on a support 17 of the adjustable hair-clamping element 12, but this is achieved in a different manner, without the support 17 being provided with a rib 31. The fact is that the tilting element 30 is in a spring-loaded arrangement on the support 17 through the biasing mechanism 40, wherein the biasing mechanism 40 comprises a leaf spring 41 that is arranged between the front side of the support 17 and an interior surface 33 of the tilting element 30.

It will be clear to a person skilled in the art that the scope of the invention is not limited to the examples discussed in the foregoing, but that several amendments and modifications thereof are possible without deviating from the scope of the invention as defined in the attached claims. It is intended that the invention be construed as including all such amendments and modifications insofar they come within the scope of the claims or the equivalents thereof. While the invention has been illustrated and described in detail in the figures and the description, such illustration and description are to be considered illustrative or exemplary only, and not restrictive. The invention is not limited to the disclosed embodiments. The drawings are schematic, wherein details which are not required for understanding the invention may have been omitted, and not necessarily to scale.

Variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. Any reference signs in the claims should not be construed as limiting the scope of the invention.

Elements and aspects discussed for or in relation with a particular embodiment may be suitably combined with elements and aspects of other embodiments, unless explicitly stated otherwise. Thus, the mere fact that certain measures are recited in mutually different dependent claims does not indicate that a combination of these measures cannot be used to advantage.

The terms "comprise" and "include" as used in this text will be understood by a person skilled in the art as covering the term "consist of". Hence, the term "comprise" or "include" may in respect of an embodiment mean "consist of", but may in another embodiment mean "contain/have/be equipped with at least the defined species and optionally one or more other species".

The indication of the tweezer surfaces 14, 15 being configured to move into alignment with each other in the process of getting into contact to each other implies that at least one of the tweezer surfaces 14, 15 is configured to perform a movement aimed at aligning with the other one of the tweezer surfaces 14, 15 in the process of contacting the other one of the tweezer surfaces 14, 15. Hence, appropriate alternative formulations of the indication as mentioned are that the tweezer surfaces 14, 15 are configured to actively align relative to each other when they are made to move into contact to each other and that the tweezer surfaces 14, 15 are configured to move into alignment relative to each other when they are made to move into contact to each other.

Notable aspects of the invention are summarized as follows. A head unit of a depilation appliance comprises at least one pair 11 of hair-clamping elements 12, 13, wherein the hair-clamping elements 12, 13 have tweezer surfaces 14, 15 which are arranged to face each other, and which are movable towards and away from each other in their entirety so as to be movable into and out of contact to each other. In order to achieve improved hair-clamping performance of the at least one pair 11 of hair-clamping elements 12, 13, the tweezer surfaces 14, 15 are further configured to move into alignment with each other in the process of getting into contact to each other, wherein the entirety of the tweezer surface 14 of one 12 of the hair-clamping elements 12, 13 is tiltable relative to a support 17 that is included in the respective hair-clamping element 12.

The invention claimed is:

1. A head unit of a depilation appliance, the head unit comprising:

at least one pair of hair-clamping elements, wherein the hair-clamping elements have tweezer surfaces that are arranged to face each other, wherein the tweezer surfaces are movable towards and away from each other in respective entireties so as to be movable into and out of contact to each other, wherein the tweezer surfaces are configured to move into alignment with each other when moving into contact to each other, wherein the entirety of the tweezer surface of one of the hair-clamping elements is tiltable relative to a support that is included in the one of the hair-clamping elements, and wherein the one of the hair-clamping elements comprises a tilting element tiltably arranged on the support and comprising a bracket clamped around the support.

2. The head unit according to claim 1, wherein the one of the hair-clamping elements is further equipped with a biasing mechanism acting on the tilting element to bias the tilting element to a default position relative to the support.

3. The head unit according to claim 2, wherein the biasing mechanism comprises a leaf spring.

4. The head unit according to claim 2, wherein the tilting element is in a spring-loaded arrangement on the support through the biasing mechanism.

5. The head unit according to claim 1, wherein the tweezer surface of the other one of the hair-clamping elements has a fixed position in the respective hair-clamping element.

6. The head unit according to claim 1, wherein the tweezer surfaces have a flat appearance, and wherein the tweezer surfaces extend parallel to each other when aligned relative to each other.

7. The head unit according to claim 1, wherein the hair-clamping elements are rotatably arranged in the head unit.

8. A depilation appliance, comprising:

the head unit according to claim 1; and a body unit configured to allow a user to take hold of the depilation appliance.

9. The depilation appliance according to claim 8, wherein the head unit and the body unit are releasably connectable to each other.

10. A head unit of a depilation appliance, the head unit comprising:

at least one pair of hair-clamping elements, wherein the hair-clamping elements have tweezer surfaces that are arranged to face each other, wherein the tweezer surfaces are movable towards and away from each other in respective entireties so as to be movable into and out of contact to each other, wherein the tweezer surfaces are configured to move into alignment with each other when moving into contact to each other, wherein one of the hair-clamping elements comprises a tilting element tiltably arranged on a support, wherein the entirety of the tweezer surface of the one of the hair-clamping elements is included in the tilting element and is tiltable relative to the support, wherein the support comprises a rib, and wherein the tilting element is arranged on the support at a position of the rib and is tiltable relative to the support about a tilting axis extending in a longitudinal direction of the rib.

11. The head unit according to claim 10, wherein the tilting element comprises a bracket clamped around the support.

12. The head unit according to claim 10, wherein the one of the hair-clamping elements is further equipped with a biasing mechanism acting on the tilting element to bias the tilting element to a default position relative to the support.

13. The head unit according to claim 12, wherein the biasing mechanism comprises a leaf spring.

14. The head unit according to claim 13, wherein the tilting element is in a spring-loaded arrangement on the support through the biasing mechanism.

15. The head unit according to claim 10, wherein the tweezer surface of the other one of the hair-clamping elements has a fixed position in the one of the hair-clamping elements.

16. The head unit according to claim 10, wherein the tweezer surfaces have a flat appearance, and wherein the tweezer surfaces extend parallel to each other when in alignment with each other.

17. The head unit according to claim 10, wherein the hair-clamping elements are rotatably arranged in the head unit.

18. A depilation appliance, comprising:

the head unit according to claim 10; and a body unit configured to allow a user to hold the depilation appliance, wherein the head unit and the body unit are releasably connectable to each other.

19. A head unit of a depilation appliance, the head unit comprising:

a first hair-clamping element having a first tweezer surface, a support, and a tilting element arranged on the support, wherein an entirety of the first tweezer surface is tiltable relative to the support, and wherein the tilting element comprises a bracket clamped around the support; and a second hair-clamping element having a second tweezer surface arranged to face the first tweezer surface, wherein the entirety of the first tweezer surface and an entirety of the second tweezer surface are movable towards and away from each other so as to be movable into and out of contact with each other, and wherein the first tweezer surface and the second tweezer surface are configured to move into alignment with each other when moving into contact with each other.

20. The head unit according to claim 19, wherein the support comprises a rib, and wherein the tilting element is arranged on the support at the rib and is tiltable relative to the support about a tilting axis extending in a longitudinal direction of the rib.

* * * * *